US010993592B2

(12) United States Patent
Shimon

(10) Patent No.: US 10,993,592 B2
(45) Date of Patent: May 4, 2021

(54) DEVICE FOR AUTOMATICALLY PROVIDING A DISPOSABLE SEATING-SURFACE COVER FOR A TOILET SEAT

(71) Applicant: Eliyahu Shimon, Jerusalem (IL)

(72) Inventor: Eliyahu Shimon, Jerusalem (IL)

( * ) Notice: Subject to any disclaimer, the term of this patent is extended or adjusted under 35 U.S.C. 154(b) by 305 days.

(21) Appl. No.: 15/669,508

(22) Filed: Aug. 4, 2017

(65) Prior Publication Data

US 2017/0332852 A1 Nov. 23, 2017

Related U.S. Application Data

(63) Continuation-in-part of application No. PCT/IL2016/050080, filed on Jan. 26, 2016.

(30) Foreign Application Priority Data

Feb. 5, 2015 (IL) ..... 237131

(51) Int. Cl.
*A47K 13/22* (2006.01)
*A47K 13/14* (2006.01)
(Continued)

(52) U.S. Cl.
CPC ..... *A47K 13/225* (2013.01); *A47K 13/02* (2013.01); *A47K 13/10* (2013.01); *A47K 13/14* (2013.01)

(58) Field of Classification Search
CPC ..... A47K 13/225; A47K 13/02; A47K 13/10; A47K 13/14
(Continued)

(56) References Cited

U.S. PATENT DOCUMENTS 1,237,548 A 8/1917 Kendall
1,589,429 A 6/1926 Rouse
(Continued)

FOREIGN PATENT DOCUMENTS

CN 101548859 A 10/2009
CN 102273977 B 10/2012
(Continued)

OTHER PUBLICATIONS

International Preliminary Report on Patentability for PCT/IL2016/050080, dated Jun. 6, 2017.
(Continued)

*Primary Examiner* — Christine J Skubinna
(74) *Attorney, Agent, or Firm* — The Roy Gross Law Firm, LLC; Roy Gross

(57) ABSTRACT

The present invention relates to a device for automatically providing a disposable seating-surface cover for a toilet-seat, comprising: a) a first housing adapted to feed a disposable seating-surface cover roll installed therein, wherein said roll is a long strip layer that comprises plurality of similar apertures, each of which defines an individual seating-surface cover; b) a second housing adapted to receive and collect the roll by connecting an initial edge of said roll to a rotational mechanism situated in said second housing that is adapted to pull said roll such that each individual disposable seating-surface cover follows a preset displacing movement where one individual disposable seating-surface cover is positioned in a state of use, wherein when an individual seating-surface cover of the roll is in a state of use, it lies directly on a seating surface of a toilet-seat, such that the aperture of the individual seating-surface cover is parallel to an aperture of said toilet seat.

15 Claims, 12 Drawing Sheets

(51) Int. Cl.
*A47K 13/02* (2006.01)
*A47K 13/10* (2006.01)

(58) Field of Classification Search
USPC ..... 4/243.3
See application file for complete search history.

(56) References Cited

U.S. PATENT DOCUMENTS

| | | | | |
|---|---|---|---|---|
| 2,243,134 | A | 5/1941 | Stiller | |
| 4,213,212 | A | 7/1980 | Hefty et al. | |
| 5,561,867 | A | 10/1996 | Roginsky | |
| 6,038,708 | A | 3/2000 | Schreck | |
| 6,615,411 | B2 * | 9/2003 | Johnson | A47K 13/225 4/243.3 |
| 2002/0088049 | A1 | 7/2002 | Johnson | |
| 2009/0106885 | A1 * | 4/2009 | Sagre | A47K 13/10 4/246.1 |

FOREIGN PATENT DOCUMENTS

| | | | | |
|---|---|---|---|---|
| CN | 102727126 | A * | 10/2012 | |
| CN | 102727126 | A | 10/2012 | |
| EP | 1169961 | A1 | 1/2002 | |
| JP | 1293826 | A | 11/1989 | |
| JP | 2-309992 | A | 12/1990 | |
| WO | 8810086 | A1 | 12/1988 | |
| WO | 9938427 | A1 | 8/1999 | |
| WO | WO-9938427 | A1 * | 8/1999 | A47K 13/22 |

OTHER PUBLICATIONS

Written Opinion for PCT/IL2016/050080, dated May 8, 2016.
International Search Report for PCT/IL2016/050080, dated May 8, 2016.

* cited by examiner

DEVICE FOR AUTOMATICALLY PROVIDING A DISPOSABLE SEATING-SURFACE COVER FOR A TOILET SEAT

FIELD OF THE INVENTION

The present invention relates to the field of sanitary equipment. More particularly, the invention relates to an automatic system for providing a disposable seating-surface cover for a toilet seat.

BACKGROUND OF THE INVENTION

Sanitation has always been a problem with regard to toilet seats, particularly in public bathrooms. Wiping the seat prior to use might be ineffective against some disease-causing organisms such as bacteria and viruses.

Several attempts have been made to address this problem. One relatively common means is the use of a circular cover which sits on the top portion of the toilet seat, with no means of securement thereon, thus this type of cover is prone to dislocation from its initial positioning.

The reference to Hefty et al., U.S. Pat. No. 4,213,212, and to Asberg, Swedish Patent No. 87682, are essentially the same and it is believed that they can be discussed together. Both references disclose a continuous tubular toilet seat cover that includes a supply reel and a take-up reel, the cover being fed around a round toilet seat from back to front and then toward the back again to complete the circle. After use, the used portion is wound up on the take-up reed which in turn pulls a new segment of the continuous tubular member around the toilet seat. In both of these references, the cover is introduced from the back edge and proceeds around the front of the seat to the opposite rear edge of the seat. In addition, both the Asberg and Hefty et al. covers are continuous so that they may be wound around the seat from the supply reel to the take-up reel. These references involve a substantial investment in the mechanisms and in the continuous threading of the reels in order for the inventions to work as they are designed.

Thus, it can be seen that a need continues to exist for a toilet seat cover that avoids the disadvantage of the known prior art. It is to this need that the present invention is addressed.

It is therefore, one of the principal objects of the present invention to provide a toilet seat cover that is easily and quickly applied and which is easily disposed after use.

A further object of the present invention is to provide a toilet seat cover that is inexpensive to produce and to use.

A still further object of the present invention is to provide a toilet seat cover designed for a single-use application and which is conveniently stored, preferably utilizing a roll upon which the product is wound.

Other objects and advantages of the invention will become apparent as the description proceeds.

SUMMARY OF THE INVENTION

The present invention relates to a device for automatically providing a disposable seating-surface cover for a toilet-seat, comprising: a) a first housing adapted to feed a disposable seating-surface cover roll installed therein, wherein said roll is a long strip layer that comprises plurality of similar apertures, each of which defines an individual seating-surface cover and each individual seating-surface cover has a control indication detectable by an optical reader; b) a second housing adapted to receive and collect the roll by connecting an initial edge of said roll to a rotational mechanism situated in said second housing that is adapted to pull said roll such that each individual disposable seating-surface cover follows a displacing movement where one individual disposable seating-surface cover is positioned in a state of use, wherein when an individual seating-surface cover of the roll is in a state of use, it lies directly on a seating surface of a toilet-seat, such that the aperture of the individual seating-surface cover is parallel to an aperture of said toilet seat; c) an electric motor located at said second housing for pulling said roll; d) an optical reader configured to capture an image of a control indication located on said individual disposable seating-surface, and responsively to stop said displacing movement; and e) a bracket arrangement adapted to install said device to said toilet seat in a way that allows said device to pivot away from said toilet seat when said device is not in use.

According to an embodiment of the invention, the rotational mechanism includes a cylindrical member 32 driven by an electric motor 8 that turns said cylindrical member 32, and on which said disposable seating-surface covers are wrapped around when said cylindrical member turns.

In another aspect, the present invention relates to a disposable seating-surface cover roll, wherein said roll is a long strip made of at least one layer, wherein the strip comprises plurality of similar apertures, each of which defines an individual seating-surface cover.

According to an embodiment of the invention the strip is wrapped around a cylindrical core.

According to an embodiment of the invention the initial edge of the strip includes an engaging member, such as a rod.

DETAILED DESCRIPTION OF THE INVENTION

Reference will now be made to several embodiments of the present invention, examples of which are illustrated in the accompanying figures. Wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

The terms, "for example", "e.g.", "optionally", as used herein, are intended to be used to introduce non-limiting examples. While certain references are made to certain example components, other components can be used as well and/or the example components can be combined into fewer components and/or divided into further components.

Figure 1:
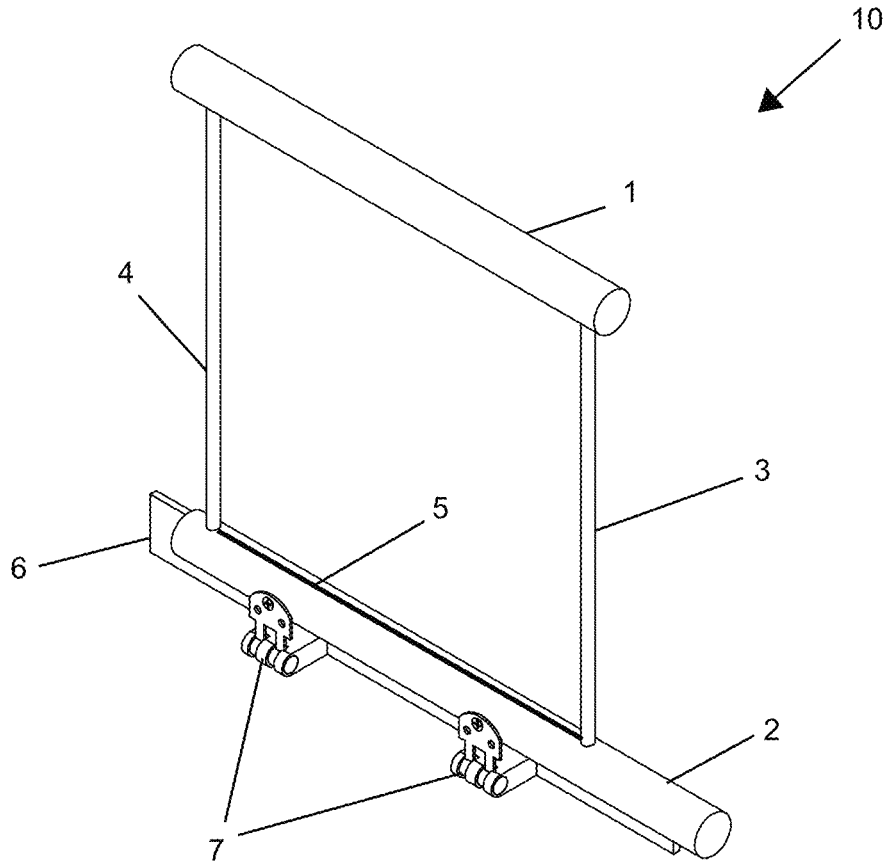
FIG. 1 schematically illustrates a perspective view of a device for providing a disposable seating-surface cover for a toilet-seat, according to an embodiment of the invention.
Figure 2:
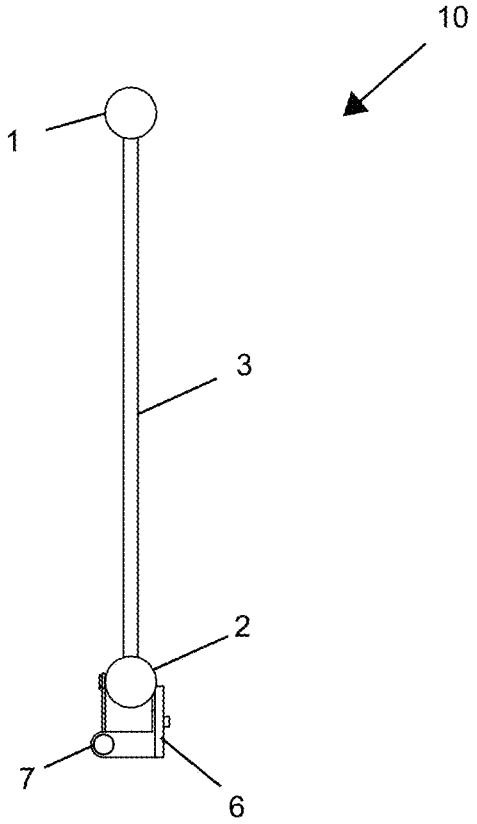
FIG. 2 schematically illustrates a side view of the device of FIG. 1.
Figure 3:
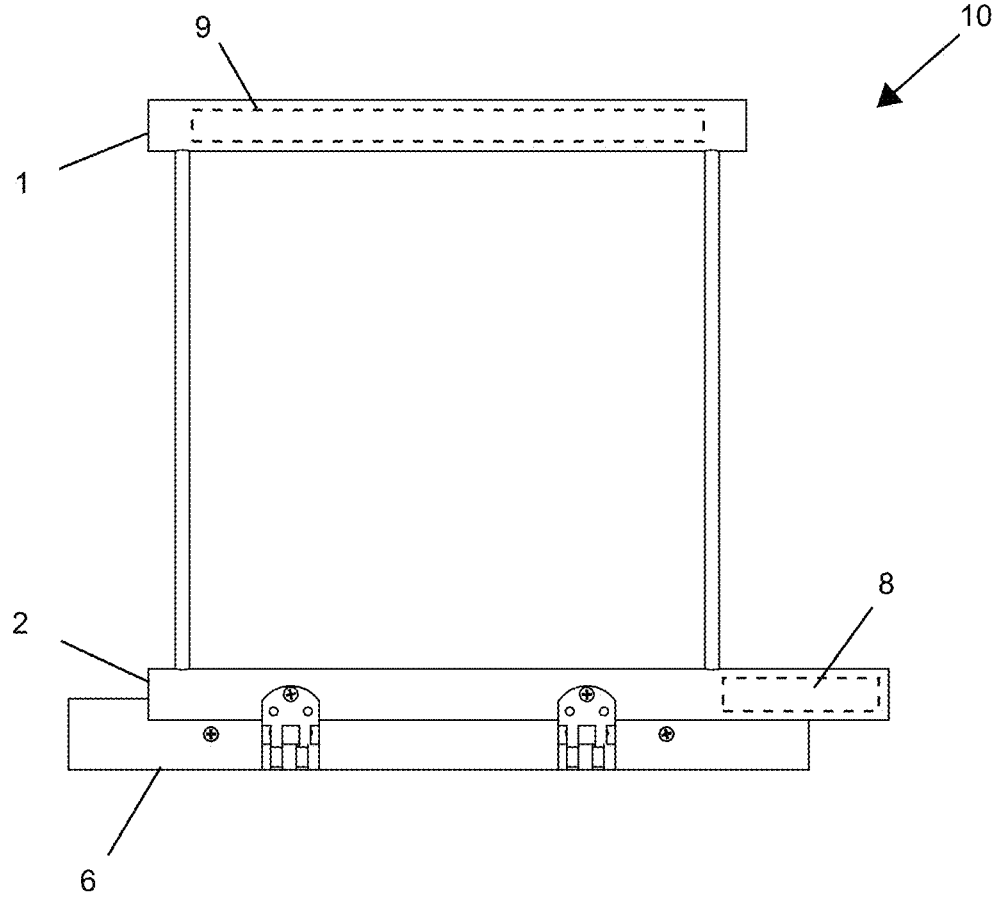
FIG. 3 schematically illustrates a bottom view of the device of FIG. 1.

FIGS. 1-3 show a device 10 that can be used in conjunction with the invention. The device 10 illustrated in this figure is particularly convenient because it can be applied as an ad-on device to existing toilet seats without the need to carry out major alterations in the structure. The device 10 comprises a feeding housing 1, a receiving housing 2, one or more supporting arms, such as arms 3 and 4 for physically connecting between housing 1 and housing 2 and for supporting the feeding of disposable seating-surface covers from housing 1 into housing 2. A rotational mechanism, driven by a motor 8 (as indicated by the dotted square in FIG. 3), is situated in housing 2, and is adapted to pull the disposable seating-surface covers from a disposable seating-surface cover roll 9 located within housing 1 (as indicated by the dotted rectangular in FIG. 3). For example, the rotational mechanism may include a cylindrical member 32 (see FIGS. 8A and 8B) or an elongated rod attached from one of its ends to a motor 8, and on which the pulled disposable seating-surface covers are wrapped around while the motor 8 turns that cylindrical member 32.

According to certain embodiments, the device 10 of the invention consists of a fixed portion and a detachable or replaceable portion. In specific embodiments, said fixed portion includes a mounting or supporting arrangement such as mounting adapter 6 (see FIGS. 6 and 12) and/or bracket arrangement 94 (see FIGS. 9B and 9C) and motor 8, wherein said detachable portion may include housing 1 or housing 2, or both, and at least one of the supporting arms (e.g., arm 4). Such an arrangement enables to easily replace the disposable seating-surface covers when needed, by detaching the detachable portion and replacing it with a new one. In a specific embodiment, the disposable seating-surface covers are provided within a disposable cartridge that enables easy replacement and installation within the device 10.

Figure 8A:
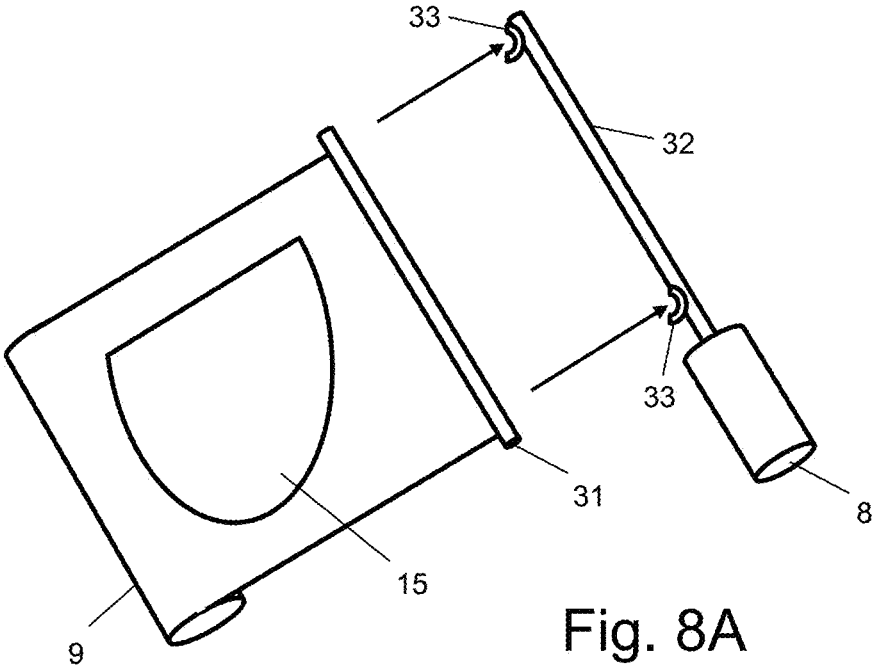
FIG. 8A schematically illustrates a roll of disposable seating-surface cover and a corresponding rotational mechanism without their housing, according to an embodiment of the invention.
Figure 8B:
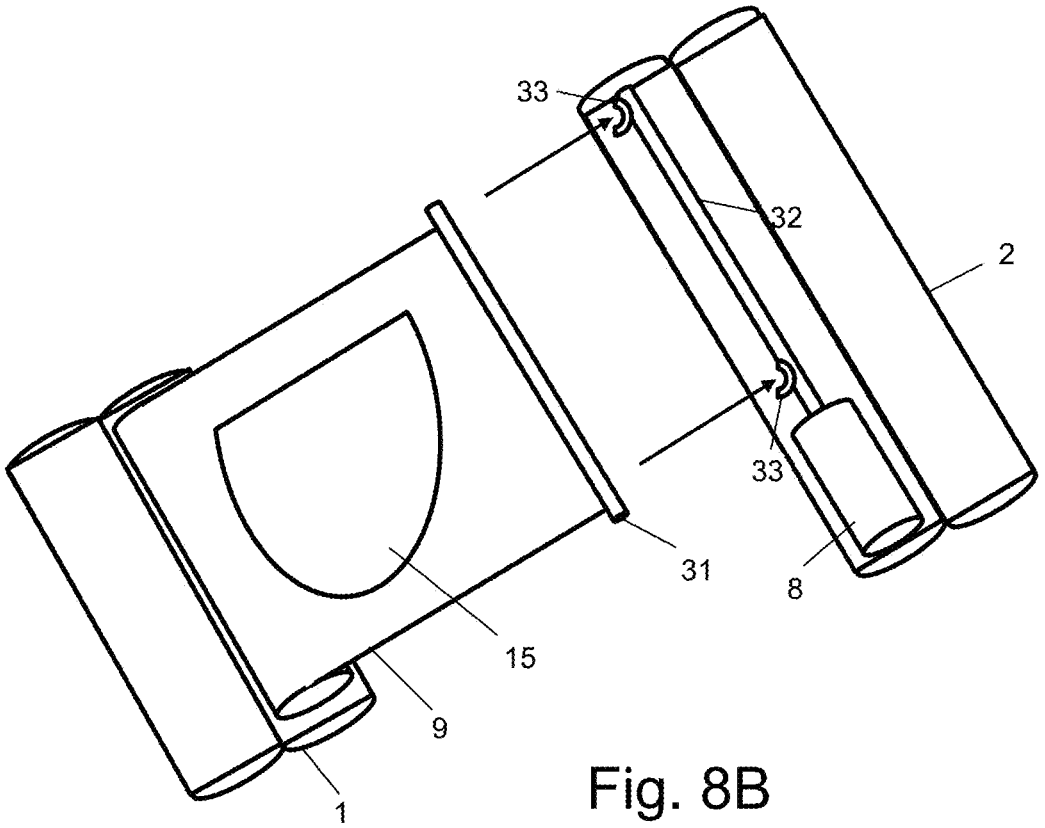
FIG. 8B schematically illustrates a roll of disposable seating-surface cover and a corresponding rotational mechanism in their housing, according to an embodiment of the invention.

Referring now to FIGS. 8A and 8B, in order to allow the rotational mechanism to pull the disposable seating-surface cover from roll 9, the initial edge of roll 9 is attached to a cylindrical member 32 by any suitable securing or engaging means. According to an embodiment of the invention, the edge of the disposable seating-surface cover may include an engaging rod 31, and the cylindrical member 32 (located at housing 2) may include a corresponding clip member(s) 33 adapted to secure the engaging rod 31 to the cylindrical member 32, such that each turning of the cylindrical member 32 will pull the disposable seating-surface cover from housing 1 into housing 2. In such arrangement, the disposable seating-surface cover moves like a one-way conveyer. FIG. 8A shows the rotational mechanism and the disposable seating-surface cover from roll 9 without their housings. FIG. 8B shows the rotational mechanism accommodated in housing 2 and the disposable seating-surface cover accommodated in housing 1. Both housing 1 and 2 are shown in their opened state allowing the insertion of roll 9 into housing 1 or the extraction of (used) roll 9 from housing 2. In this exemplary embodiment, both housing 1 and 2 have a cylindrical form which opens in a clamshell manner. As will be appreciated by a person skilled in the art, other forms (e.g., rectangular box) and opening arrangements can also be utilized for housing 1,2.

Mounting means, e.g., as indicate d by mounting adapter 6 and hinges 7, can be used to install the device 10 such that it can be used with a toilet module, as will be described in further details with respect to FIGS. 4-6 hereinafter.

Figure 4:
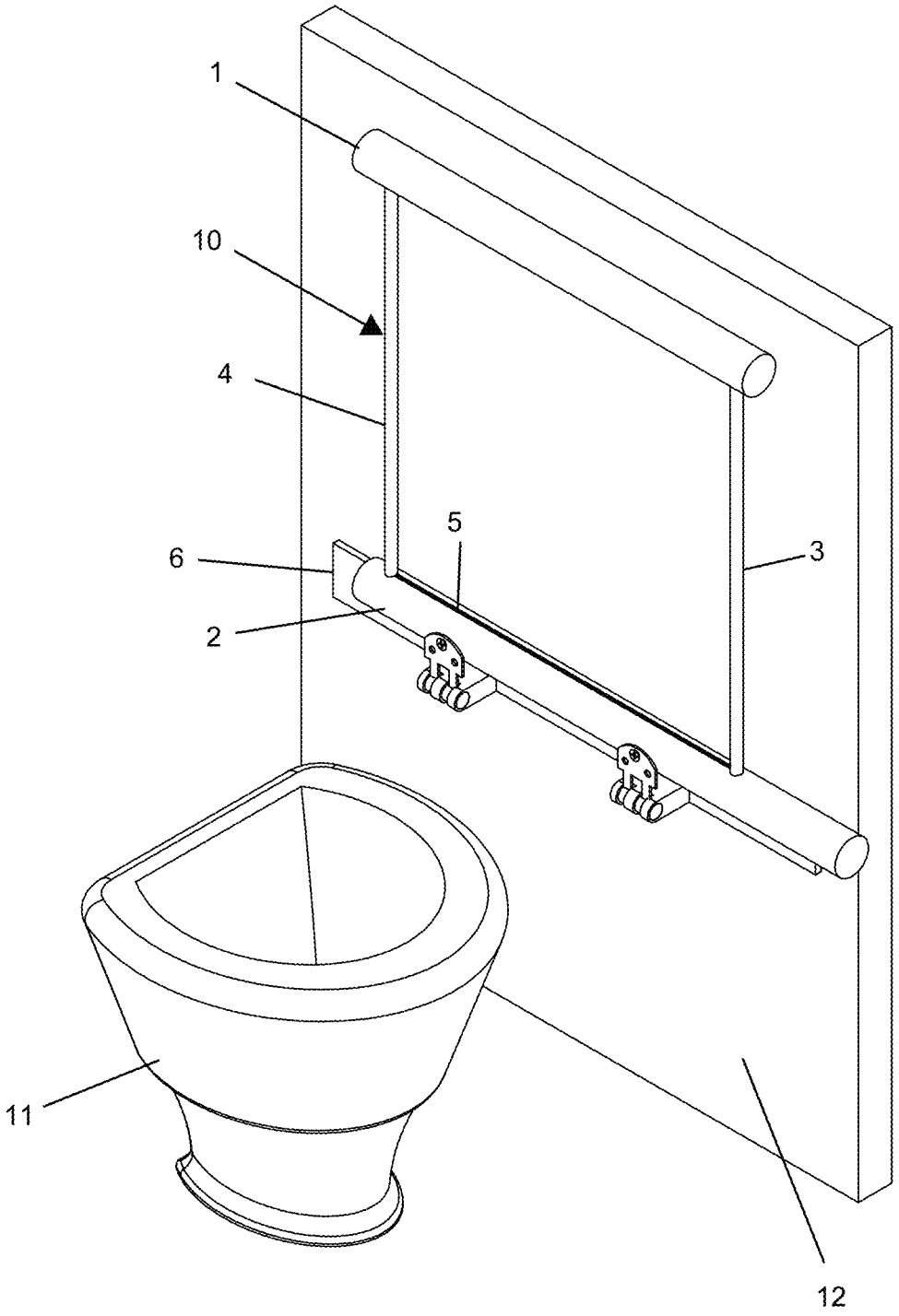
FIGS. 4-6 schematically illustrate an exemplary installation of the device of FIG. 1 in a toilet, according to an embodiment of the invention.
Figure 5:
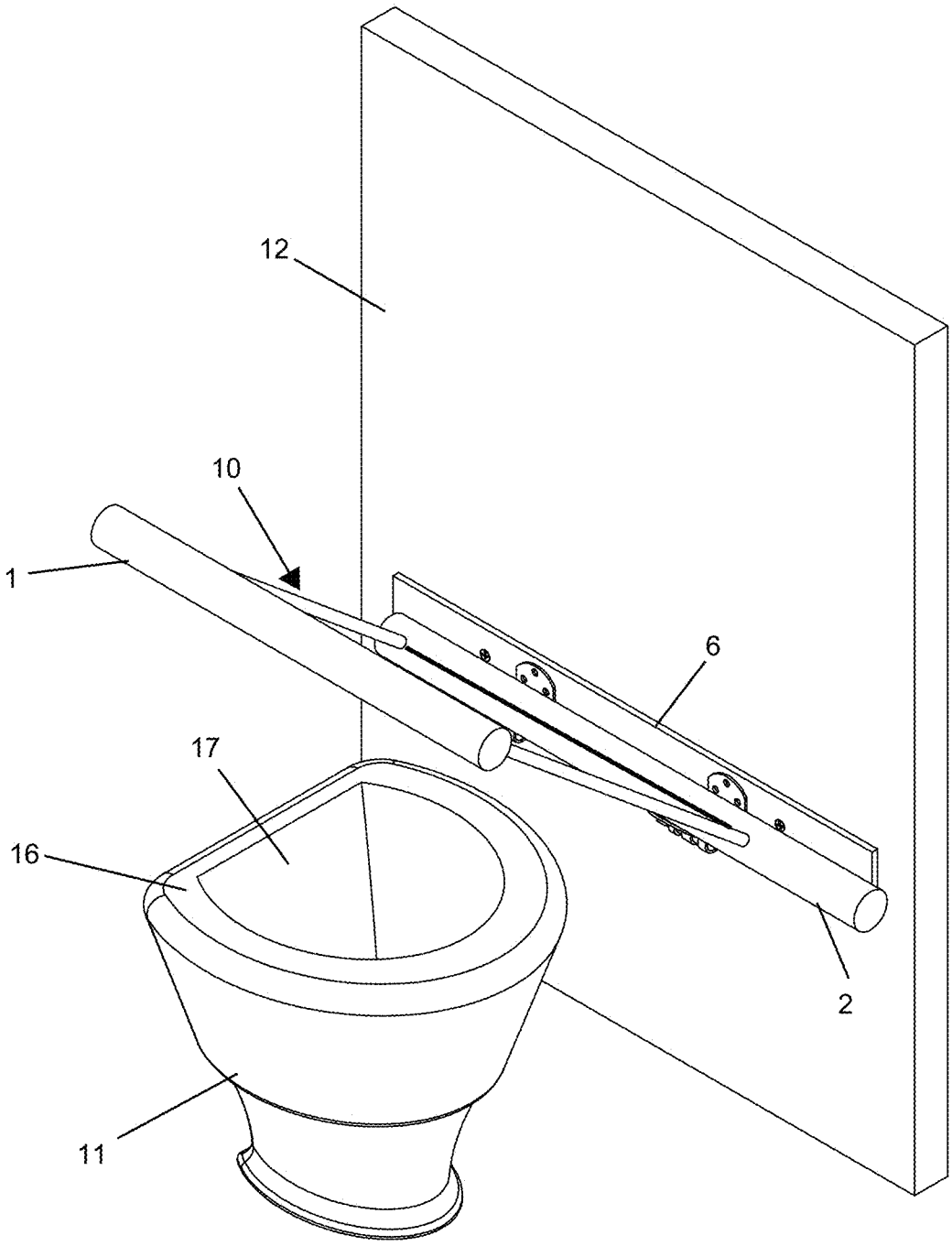
Figure 6:
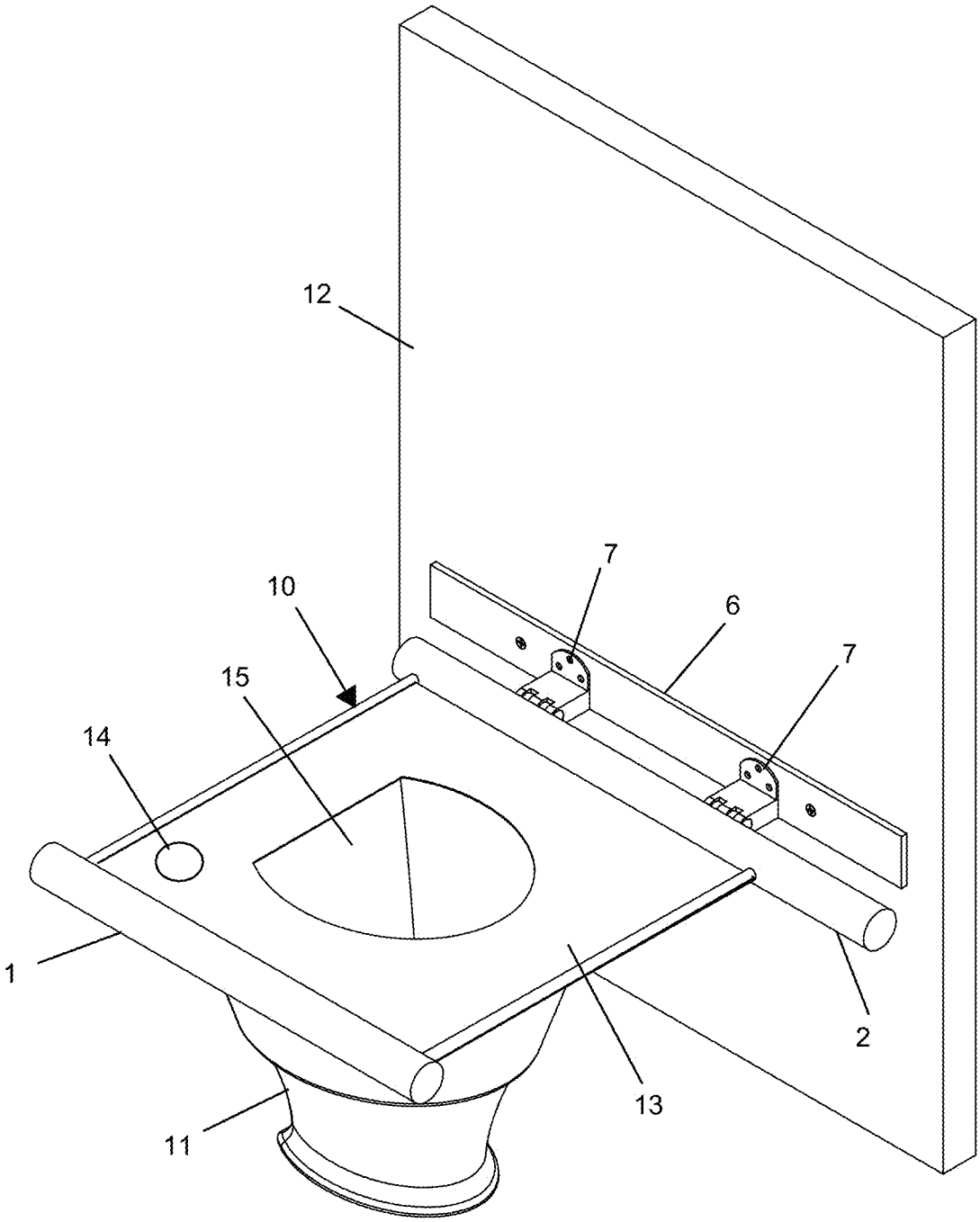

As shown in FIGS. 4-6, the device 10 is mounted (via the mounting means) on a wall 12 adjacent to a toilet module 11 so as to be foldable between a closed state (i.e., ready for use) and an open state. Alternatively, the device 10 can be mounted directly to the toilet module 11 as will be described hereinafter with respect to FIGS. 9A and 9B. In FIG. 4, a device 10 is shown in its open state, whereas in FIG. 6 the device 10 is represented in its closed state. For example, when mounting the device 10 on a wall, the mounting adapter 6 may include telescopic arms or other adjusting arrangement adapted to accurately fit the device 10 to a nearby toilet module (due to a gap between the wall and the location of the toilet seat, which is usually different from one toilet room constellation to another).

Toilet module 11 may comprise common toilets elements such as a toilet-seat flap 16, a toilet lid (not shown), a water tank (not shown), etc. The toilet-seat flap 16 has a seating surface and it is generally constructed as a seating ring, in which case there is understood to be, under said seating ring, a surface with an aperture 17 (a hole or a clearance). The toilet-seat flap 16 is usually produced from plastic which is hypoallergenic, washable and so stable that said toilet-seat flap 16 withstands the load constituted by a user who is sitting on it.

The toilet-seat flap 16 has a substantially rounded outer periphery. The aperture 17 has a substantially elliptical inner periphery. The center of the surface described by the inner periphery of aperture 17 and the center of the surface described by the outer periphery of toilet-seat flap 16 are located substantially concentrically in relation to one another.

Each individual disposable seating-surface cover 13 of the roll 9 (see FIG. 6) is adapted to cover the seating surface of the toilet-seat flap 16 in order to avoid any contact between a user and said toilet-seat flap 16. In a state of use, said individual disposable seating-surface cover 13 covers the seating surface of the toilet-seat flap 16 in such a way that, when sitting on the seating surface of the toilet-seat flap 16, a user has no direct contact of any kind with the toilet-seat flap 16 itself via his or her buttocks. When the disposable seating-surface cover 13 is in the state of use, it is suitable for use by a user and lies directly on the seating surface of the toilet-seat flap 16 in un-deformed, flat and smoothly stretched manner (see FIG. 6). The state of use of the disposable seating-surface cover 13 may be understood to be a position of use and an orientation of use of said cover.

According to an embodiment of the invention, roll 9 is a long strip of plastic, nylon or other suitable material(s) to keep germs and wetness away. For example, the strip can be a soft non-woven fabric for comfort, coated with a layer of plastic that are wrapped around a cylindrical core. In a specific embodiment, the strip is made of a combination of plastic and toilet paper. Roll 9 is adapted to be stored in the feeding housing 1 (i.e., the dispensing side). The strip comprises plurality of similar apertures (e.g., as indicated by numeral 15 in FIG. 6), each of which defines an individual seating-surface cover 13. The rotational mechanism adapted to pull each single seating surface cover at a time, either by automatically detecting a user that has finished using the toilet or by manually activating the motor (e.g., via a dedicated control button or a triggering arrangement).

In specific embodiments of the invention, the strip constituting the roll 9 includes a flushable and detachable portion/layer (not shown) that is detachably connected to the circumference of the aperture 15. Such a flushable and detachable layer is used to maintain the interior of the toilet bowl in a clean condition while it is being used, as such layer can be used to partially cover the interior of the toilet bowl and thus prevent feces from adhering to the inner walls of the toilet module 11.

The surface area of each defined single seating-surface cover 13 is equal to the seating surface, which is to be covered for hygiene purposes, of the toilet-seat flap 16. The disposable seating-surface cover 13 has a substantially rectangular outer periphery and the aperture that defines each single cover has a substantially elliptical inner periphery. The center of the surface area described by the inner periphery and the center of the surface area described by the outer periphery are located substantially concentrically in relation to one another. The geometry/shape of each individual seating-surface cover 13 is adapted to the geometry/shape of toilet-seat flap 16 in such a way that said individual seating-surface cover 13 completely covers the seating surface of said toilet-seat flap 16. Furthermore, the aperture 15 is adapted in its size, position and orientation, when the disposable seating-surface cover 13 is in the state of use, to the aperture 17 in the toilet-seat flap 16.

Device 10 operates as a conveying apparatus that is adapted to convey a portion of roll 9 that defines the disposable seating-surface cover 13 onto the seating surface of the toilet-seat flap 16. In doing so, device 10 slides each single defined disposable seating-surface cover 13, as represented by the black arrows in FIGS. 7A and 7B, and deposits said disposable seating-surface cover 13 on the seating surface in its state of use. Motor 8 operates for the purpose of conveying said disposable seating-surface cover 13. The motor 8 drives roll 9 in such a way that each individual disposable seating-surface cover 13 follows a preset displacing movement. Device 10 therefore transfers the disposable seating-surface cover 13 from its storage state into its state of use and then to its collection state. Upon completing using the entire disposable seating-surface covers 13, roll 9 is collected at the receiving housing 2, i.e., wrapped around cylindrical member 32 (see FIGS. 8A and 8B).

Device 10 also comprises the two supporting rails 3 and 4. Said rails run parallel to one another and extend substantially parallel to the seating surface of the toilet-seat flap 16. With the aid of the rails 3 and 4 the disposable seating-surface cover 13 is mounted so as to be displaceable along said rails 3,4. Under these circumstances, the feeding of the covers 13 can be easily conveyed forward to the receiving housing 2. In a receiving state, housing 2 collects/receives the disposable seating-surface cover 13. In the course of the conveying operation, the feeding process in (see FIGS. 7A and 7B) describes a displacement that follows a straight path. There is therefore substantially a parallel displacement of the disposable seating-surface cover 13 relative to the toilet-seat flap 16.

Figure 7A:
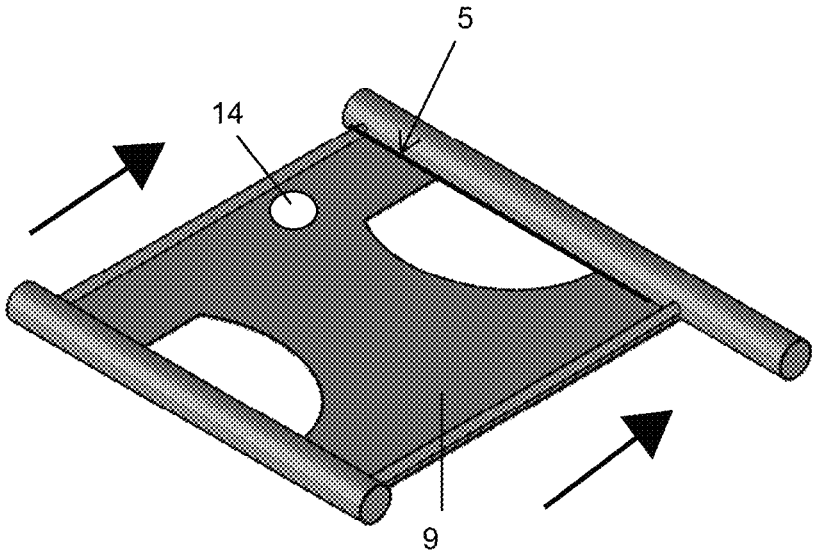
FIG. 7A schematically illustrates a perspective view of a feeding process of the disposable seating-surface cover.
Figure 7B:
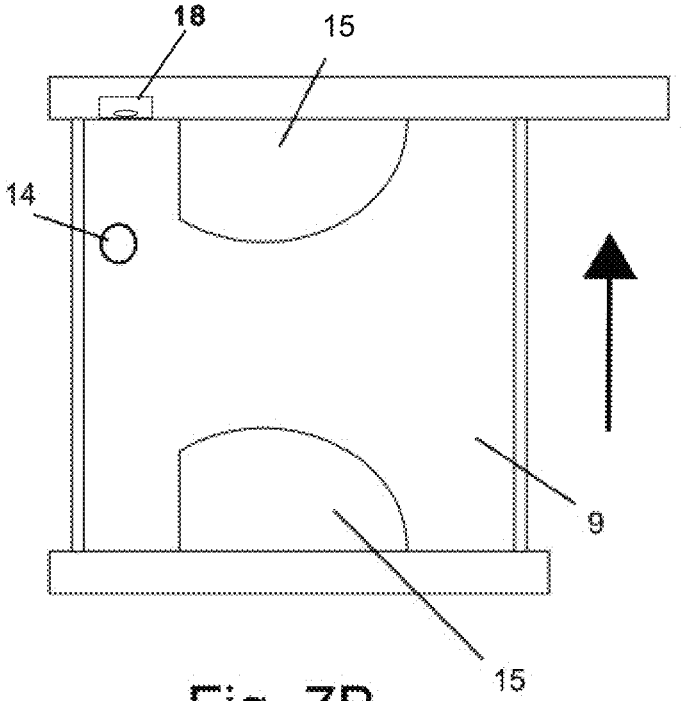
FIG. 7B schematically illustrates a top view of the feeding process of FIG. 7A.

It can also be seen in FIGS. 5 and 7A, that housing 2 has a receiving slit 5. Device 10 is adapted to convey the disposable seating-surface cover 13 out of the housing 1 through the receiving slit 5 and onto the cylindrical member 32 (FIGS. 8A and 8B).

Figure 9A:
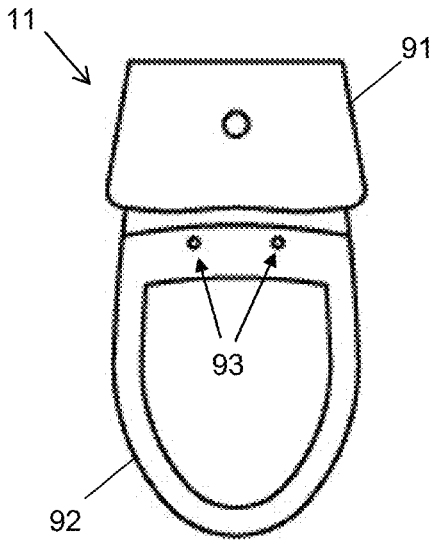
FIG. 9A schematically illustrates a top view of a conventional toilet module without the toilet seat flap and lid.
Figure 9B:
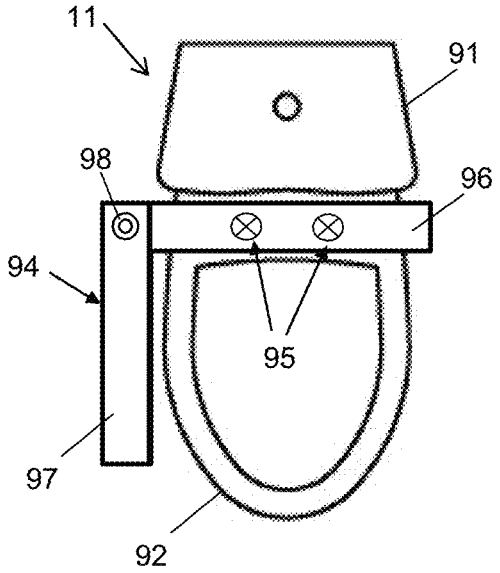
FIGS. 9B and 9C schematically illustrate a bracket arrangement attached to the toilet of FIG. 9A for allowing the installation of the device of FIG. 1 directly to the toilet module, according to an embodiment of the invention.
Figure 9C:
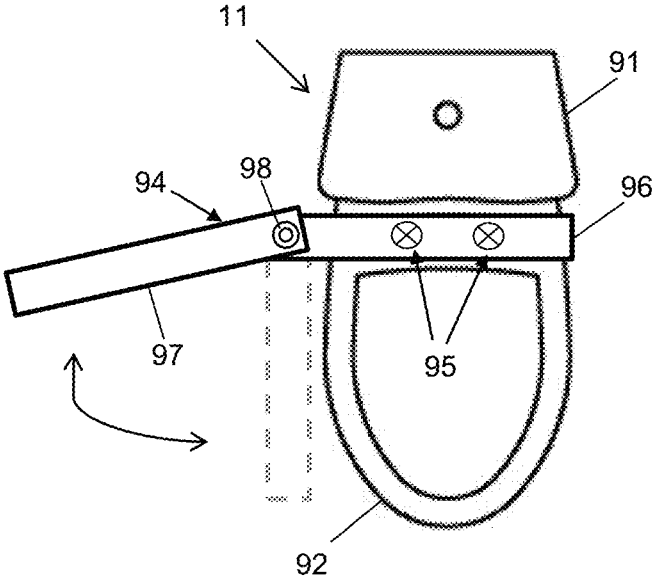
Figure 10:
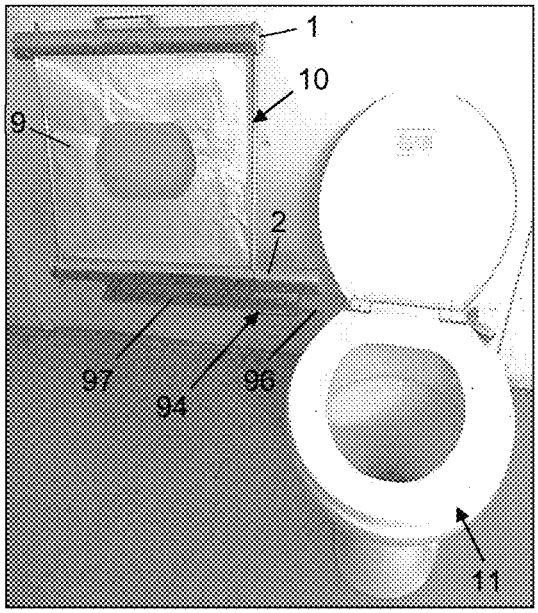
FIGS. 10-12 show an exemplary installation of device 10 to a toilet module, according to an embodiment of the present invention.
Figure 11:
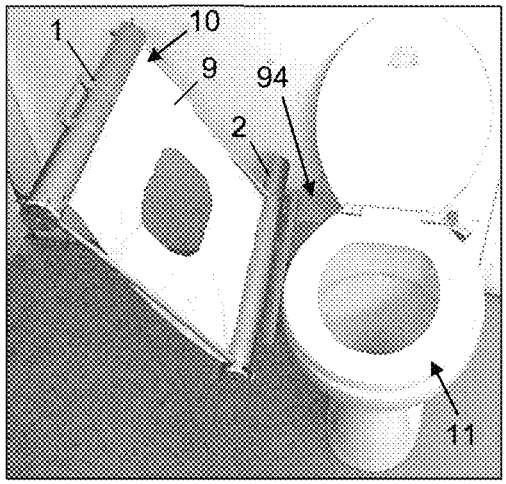
Figure 12:
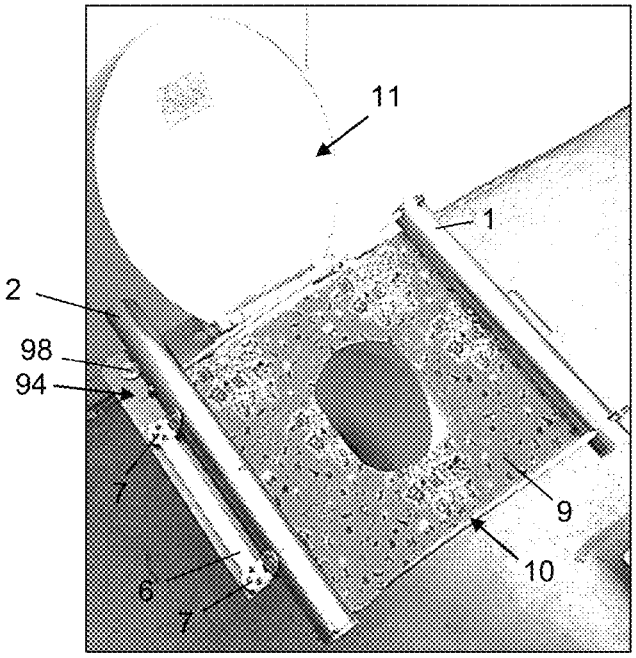

FIG. 9A schematically illustrates a top view of a conventional toilet module 11. Toilet module 11 includes a water tank 91, a toilet seat base 92 and two holes 93 located on base 92 that are usually used for attaching a corresponding set of a toilet seat flap and a lid (not shown), to base 92. FIGS. 9B and 9C schematically illustrate a bracket arrangement 94 attached to base 92 of toilet module 11 of FIG. 9A via holes 93, e.g., using corresponding screws 95 or other tightening means. Bracket arrangement 94 has an essentially "L" like shape that is defined by two arms 96 and 97. In some embodiments, arms 96 and 97 are pivotally connected via an axis 98, thereby allowing device 10 to pivot away from the toilet seat (see FIG. 9C and FIG. 10) when device 10 is not in use, e.g., when cleaning the toilet. In this figure, arm 96 is attached to base 92 (using screws 95) and arm 97 is used for installing device 10 on top of it similar to the wall installation described hereinabove, e.g., using the mounting adapter 6 (see FIG. 12). Such installation does not require any walls or surface to be located adjacent to the toilet module 11. The set of the toilet seat flap and a lid can be also so attached on top of arm 96 of said bracket arrangement 94 using the same screws 95 (see FIGS. 10-12). FIGS. 10-12 show an exemplary installation of device 10 to a toilet module 11 using the bracket arrangement 94 described hereinabove.

Figure 13:
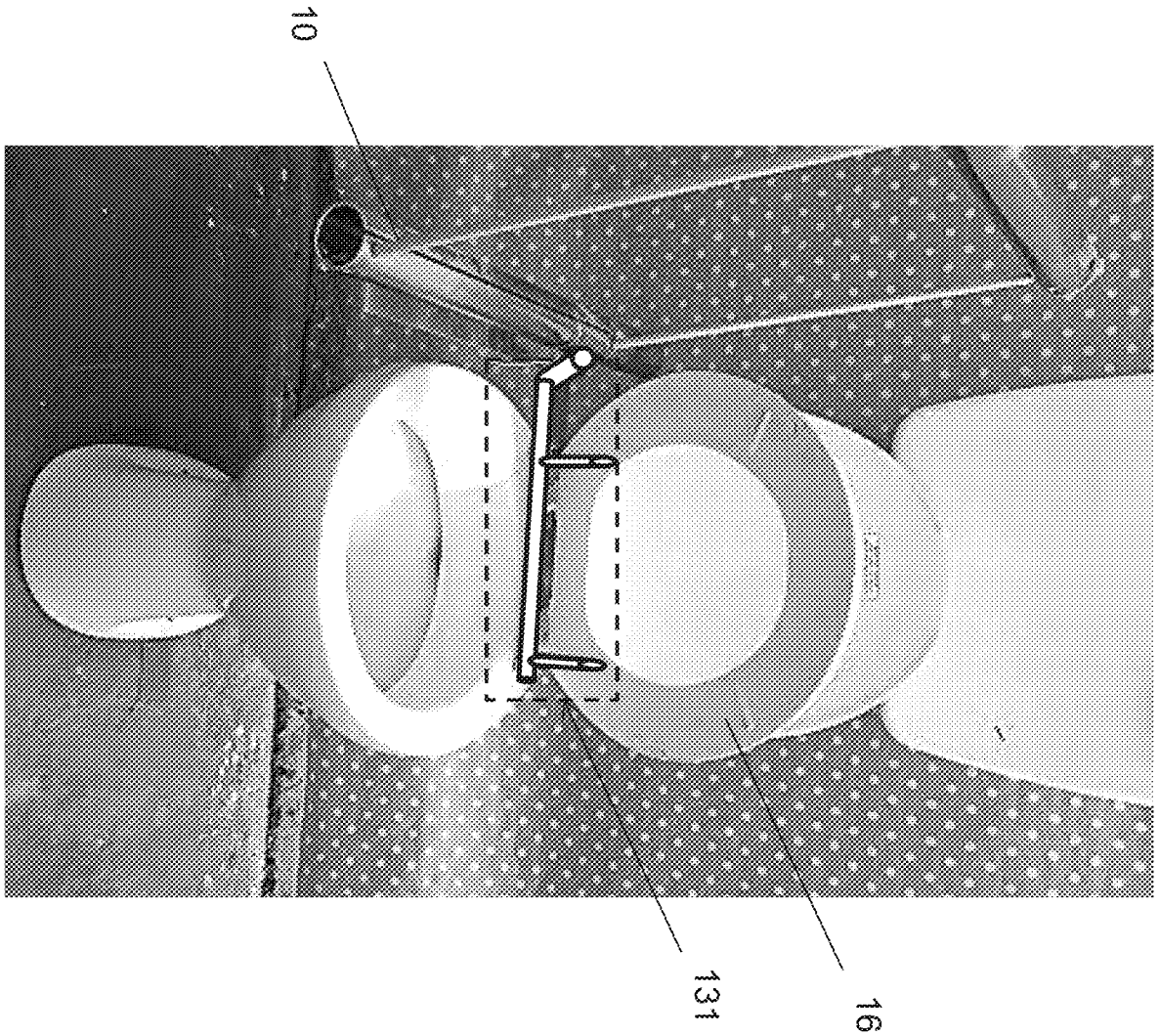
FIGS. 13-14 show device 10 provided with a lifting arm and installed on a toilet seat, according to an embodiment of the invention.
Figure 14:
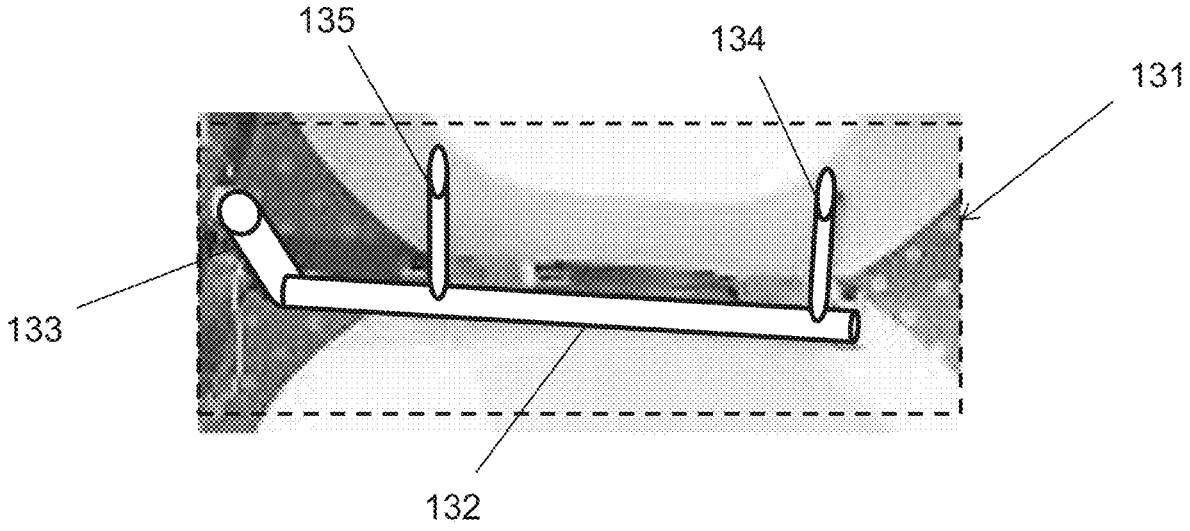
Figure 15:
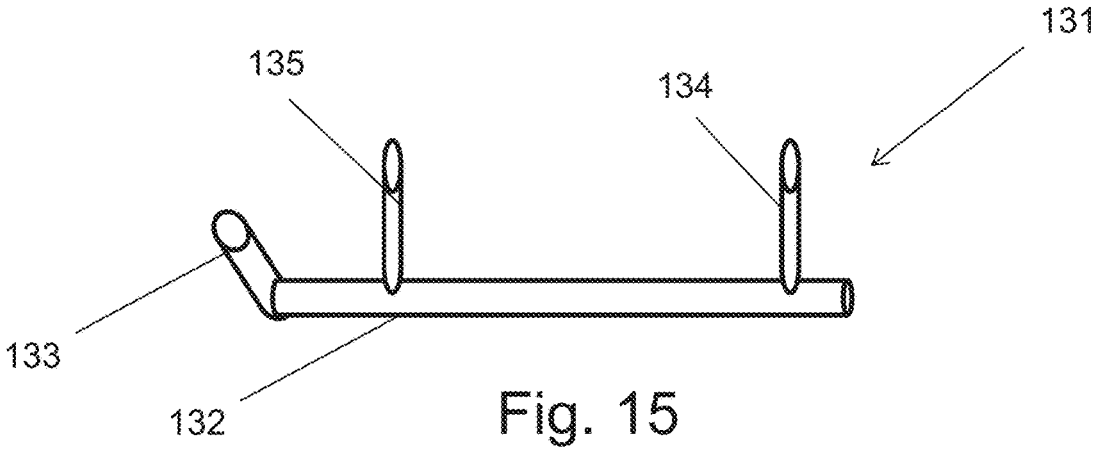
FIG. 15 schematically illustrates a lifting arm, according to an embodiment of the invention.

Referring now to FIGS. 13-15, according to some embodiments of the invention, device 10 comprises a toilet-seat flap lifting arm 131. Lifting arm 131 is configured to lift the toilet-seat flap 16 when device 10 is not in use (i.e., in an open state) and vice versa. Lifting arm 131 can be an integral part of device 10 and may be operated automatically when device 10 is foldable between a closed state (i.e., ready for use) and an open state. For example, lifting arm 131 can be connected to the bracket arrangement 94 in such way that it will transmit the force from the lifting of device 10 (to an open state) to the lifting arm 131 to form a lever point (e.g., at the bottom of toilet-seat flap 16, as shown in FIG. 14). Alternatively, lifting arm 131 can be part of an independent lifting mechanism operated either manually (e.g., by foot pedal mechanism) or automatically (e.g., by an electric motor).

FIG. 15 schematically illustrates a lifting arm 131, according to an embodiment of the invention. Lifting arm 131 comprises a rotatable base bar 132, a handle 133 and one or more upright lifting arms as indicated by numerals 134 and 135. Handle 133 can be connected to an actuating mechanism such as bracket arrangement 94 of device 10 or to an external mechanism such as foot operated pedal. Upon applying an actuating force by the actuating mechanism, handle 133 forces the rotatable base bar 132 to move and to transmit the actuating force to toilet seat flap via the physical contact of the upright lifting arms 134 and 135 with the toilet seat flap.

According to an embodiment of the invention, a toilet seat flap and a toilet lid can be an integrated part of device 10, such that an installation of device 10 will also provide the toilet seat flap and the toilet lid. For example, such an arrangement can be used as a kit for replacing an existing toilet seat flap and lid.

According to an embodiment of the present invention, the triggering arrangement is adapted to control the conveying of the disposable seating-surface cover 13. On receiving a triggering signal, device 10 brings about a transfer of each defined disposable seating-surface cover 13 from its storage state into its state of use. For example, a control indication 14, e.g., in from of at least one aperture or at least one printed sign on cover 13, can be located adjacent to each aperture 15 in order to define a single cover at the disposable seating-surface cover 13. Control indication 14 can be used to indicate when to stop the feeding process (e.g., the rotation of motor 8). For example, an optical reader 18 located at housing 1, 2 and/or 3 can be configured to capture visual information (i.e. an image) of control indication 14 and to translate the image into digital information that reflects the triggering signal (i.e., when to stop the feeding of cover 13). As will be appreciated by a person skilled in the art, the feeding process can be applied by using electronic, kinematic, hydraulic and/or pneumatic construction.

In specific embodiments, when not in use, the device 10 of the invention is in its open state, i.e. the toilet seat flap 16 and lid are lifted and the device 10 is in an upright position (nor laying on the toilet seat flap 16). Once a user enters the bathroom or toilet, the device 10 is activated automatically (or turned on by the user) thereby lowering the toilet seat flap 16 and the device 10 into the closed state (i.e. ready for use), and a fresh/new disposable seating-surface cover 13 of the roll 9 is moved into place over the toilet seat flap 16 so that the user can see that a new cover has been set. The optical reader 18 captures visual information (i.e. the control indication 14) located on the cover 13, and instruct the electric motor 8 to stop pulling to thereby precisely place a cover 13 over the aperture 17 of the toilet seat flap 16. Once the user concludes and exits the toilet, an electronic sensor identifies the user's departure (or the user turns a switch off) and returns the device 10 back to its open state.

In certain embodiments, the device 10 comprises two separate electronic motors: a motor 8 for turning a cylindrical member 32 and pulling used sections of the disposable seating-surface covers; and a motor for moving the device 10 from an open position to a closed position, i.e. lifting and lowering the device and/or the toilet seat flap 16.

In certain embodiments, the device 10 further comprises an electronic control system for coordinating all the engines and sensors therewithin and associated therewith, as well as various switches and gears required for operating the device 10.

In certain embodiments, the device 10 further comprises a display unit for presenting status of the device, remaining amount/units of the disposable seating-surface covers, the need to replace/remove the used disposable seating-surface covers, energy level (when batteries are used), etc.

In specific embodiments, the device 10 is associated with the water flushing system and enables automatic flushing of the water once the user finishes and exits the toilet.

As will be appreciated by the skilled person the arrangement described in the figures results in an automatic system for providing a disposable seating-surface cover for a toilet-seat, that is easily and quickly applied and which is easily disposed after use.

While an embodiment of a disposable toilet seat cover and modifications thereof have been shown and described in detail herein, various additional changes and modifications may be made without departing from the scope of the present invention.

The invention claimed is:

1. An automatic device for providing a disposable individual seating-surface cover for a toilet-seat flap, comprising:

a) a first housing adapted to feed a disposable seating-surface cover roll installed therein, wherein said cover roll is a long strip layer that comprises a plurality of apertures, each aperture defines an individual seating-surface cover and each individual seating-surface cover has a control indication detectable by an optical reader;

b) a second housing adapted to receive and collect said roll by connecting an initial edge of said roll to a rotational mechanism situated in said second housing and equipped with an electric motor designed to rotate said rotational mechanism for pulling said roll and position of each individual seating-surface cover in a state of use, such that the aperture of the individual seating-surface cover is parallel to an aperture of said toilet-seat flap, wherein said first and second housings are physically connected by supporting rails or arms;

c) an optical reader located at said first housing and/or said second housing, wherein said optical reader is configured to capture visual information of said control indication to trigger a signal to stop the polling of said roll by stopping said electric motor;

d) an electric motor for pulling said roll;

e) a lifting arm associated with an electric motor for enabling a hands-free lifting/lowering of a toilet-seat flap of a toilet-seat base and said first housing and second housing; and f) a bracket arrangement adapted to install said device to said toilet-seat base, wherein said device is designed to automatically provide, according to need, a new individual seating-surface cover over a toilet-seat flap by: identifying the arrival of a user, lowering the device together with said toilet-seat flap onto the toilet-seat base, rolling a new individual seating-surface cover over the toilet-seat flap, identifying that the user stood up and automatically lifting the device and toilet-seat flap from the toilet-seat base after use, wherein identifying that the user stood up is carried out by periodically activating said electric motor that pulls the roll to identify the removal of pressure therefrom.

2. The device according to claim 1, wherein each of said individual seating-surface covers is placed over a seating surface of a toilet-seat flap in un-deformed, flat and smoothly stretched manner.

3. The device according to claim 1, wherein said first and second housings are designed to enable easy and quick insertion and removal of a new roll and a roll of used covers.

4. The device according to claim 1, wherein said rotational mechanism includes a cylindrical member driven by said electric motor that turns said cylindrical member, and on which said individual seating-surface covers are wrapped around when said cylindrical member turns.

5. The device according to claim 1, further comprising a toilet-seat flap and a toilet lid, thereby providing a toilet-seat kit comprising the disposable seating-surface cover roll.

6. The device according to claim 1, in which the control indication is at least one sign printed on each individual seating-surface cover.

7. The device according to claim 4, in which said disposable seating surface cover roll includes at its beginning an engaging member and said second housing includes a corresponding clip member(s) adapted to secure said engaging member to said cylindrical member, such that each turning said cylindrical member pulls the disposable seating surface cover from said first housing into said second housing.

8. The device according to claim 1, in which the pulling of the cover is by using electronic or kinematic construction.

9. A roll of disposable individual seating-surface covers adapted to be stored in a first housing of a device according to claim 1, wherein said roll is a long strip layer that comprises a plurality of similar apertures, each of which defines an individual seating-surface cover, wherein said roll comprises a control indication located adjacent to each of said aperture to indicate when to stop the feeding process of each individual seating-surface cover, wherein said control indication is in form of a printed sign suitable to be read by an optical reader.

10. The roll according to claim 9, in which the strip is wrapped around a cylindrical core.

11. The roll according to claim 9, in which the edge of the strip includes an engaging member adapted to secure to a at least one corresponding clip member at a second housing adapted to receive and collect the roll.

12. The roll according to claim 9, in which the engaging member is a rod.

13. The roll according to claim 9, in which the control indication is at least one sign printed on each individual seating-surface cover.

14. A method for automatically providing a disposable individual seating-surface cover over a toilet-seat flap, comprising:

(i) mounting a device according to claim 1 onto a toilet-seat base with a toilet-seat flap;

(ii) filling a disposable seating-surface cover roll into the first housing and connecting the tip of the cover to the rotational mechanism in the second housing; and (iii) activating the device, wherein activation of the device provide a new individual seating-surface cover for said toilet-seat flap before every use by: identifying the arrival of a user, lowering the device together with said toilet-seat flap onto the toilet-seat base, rolling a new individual seating-surface cover over the toilet-seat flap, identifying that the user stood up and automatically lifting the device and said toilet-seat flap from the toilet-seat base after use, wherein identifying that the user stood up is carried out by periodically activating said electric motor that pulls the roll to identify the removal of pressure therefrom.

15. The method according to claim 14, wherein each of said individual seating-surface covers is placed over a seating surface of a toilet-seat flap in un-deformed, flat and smoothly stretched manner.

* * * * *